US009540961B2

(12) United States Patent
Artinian et al.

(10) Patent No.: US 9,540,961 B2
(45) Date of Patent: Jan. 10, 2017

(54) HEAT SOURCES FOR THERMAL CYCLES

(71) Applicant: Access Energy LLC, Cerritos, CA (US)

(72) Inventors: Herman Artinian, Huntington Beach, CA (US); Keiichi Shiraishi, Nagasaki (JP)

(73) Assignee: Access Energy LLC, Cerritos, CA (US)

( * ) Notice: Subject to any disclaimer, the term of this patent is extended or adjusted under 35 U.S.C. 154(b) by 59 days.

(21) Appl. No.: 13/870,320

(22) Filed: Apr. 25, 2013

(65) Prior Publication Data

US 2014/0318131 A1 Oct. 30, 2014

(51) Int. Cl.
*F01K 23/10* (2006.01)

(52) U.S. Cl.
CPC ..... *F01K 23/10* (2013.01)

(58) Field of Classification Search
CPC ..... F25B 27/00; F01K 25/00; F01K 27/00
USPC . 60/598, 600, 602, 604, 605, 612; 123/48 R
See application file for complete search history.

(56) References Cited

U.S. PATENT DOCUMENTS

| | | | | |
|---|---|---|---|---|
| 1,977,958 | A | 10/1934 | Rijswijk | |
| 3,748,057 | A | 7/1973 | Eskeli | |
| 3,793,848 | A | 2/1974 | Eskeli | |
| 3,795,461 | A | 3/1974 | Eskeli | |
| 3,886,748 | A | 6/1975 | Bronicki | |
| 4,039,846 | A | 8/1977 | Vance | |
| 4,117,344 | A | 9/1978 | Boerstler et al. | |
| 4,311,010 | A | 1/1982 | Wurmfield | |
| 4,461,154 | A | 7/1984 | Allam | |
| 4,901,531 | A * | 2/1990 | Kubo | F01K 23/065 60/618 |
| 5,755,556 | A | 5/1998 | Hultgren et al. | |
| 6,321,552 | B1 * | 11/2001 | Frederiksen | B60H 1/32 123/41.23 |
| 6,880,344 | B2 | 4/2005 | Radcliff et al. | |
| 7,124,584 | B1 | 10/2006 | Wetzel et al. | |
| 7,629,701 | B2 | 12/2009 | Campanile et al. | |
| 7,721,543 | B2 * | 5/2010 | Massey | F01P 9/02 60/39.511 |

(Continued)

FOREIGN PATENT DOCUMENTS

| | | | |
|---|---|---|---|
| EP | 2500530 | A1 | 9/2012 |
| JP | 2011231636 | A | 11/2011 |

(Continued)

OTHER PUBLICATIONS

Final Office Action issued in U.S. Appl. No. 13/556,821 on Sep. 18, 2014, 17 pages.

(Continued)

*Primary Examiner* — Thomas Denion
*Assistant Examiner* — Shafiq Mian
(74) *Attorney, Agent, or Firm* — Fish & Richardson P.C.

(57) ABSTRACT

Systems, methods, and apparatuses are directed to monitoring a capacity at which an engine is operating, the engine comprising a turbocharger. It can be determined whether the engine is operating above a threshold capacity. If the engine is operating above a threshold capacity, a closed-loop thermal cycle working fluid can be heated with heated air from the turbocharger. If the engine is operating at or below a threshold capacity, the working fluid can be heated with exhaust from the engine. The heated working fluid can be directed to a turbine generator, which can generate electrical power.

8 Claims, 4 Drawing Sheets

(56) References Cited

U.S. PATENT DOCUMENTS

| | | | | |
|---|---|---|---|---|
| 7,942,001 | B2 | 5/2011 | Radcliff et al. | |
| 8,276,383 | B2 | 10/2012 | Sami | |
| 8,327,641 | B2 | 12/2012 | Freund et al. | |
| 8,534,039 | B1 | 9/2013 | Pierson et al. | |
| 2004/0020206 | A1 | 2/2004 | Sullivan et al. | |
| 2004/0055300 | A1 | 3/2004 | Lawheed | |
| 2006/0117753 | A1 | 6/2006 | Bronicki | |
| 2007/0193265 | A1 | 8/2007 | Skotte et al. | |
| 2007/0277523 | A1* | 12/2007 | Muller | F01P 7/165 60/599 |
| 2008/0163618 | A1 | 7/2008 | Paul | |
| 2008/0187789 | A1* | 8/2008 | Ghezel-Ayagh | F02C 1/007 429/414 |
| 2009/0165456 | A1 | 7/2009 | Masada | |
| 2009/0211253 | A1* | 8/2009 | Radcliff | F01K 23/065 60/670 |
| 2009/0277400 | A1* | 11/2009 | Conry | F01N 5/02 123/2 |
| 2009/0301078 | A1 | 12/2009 | Chillar et al. | |
| 2009/0320477 | A1 | 12/2009 | Juchymenko | |
| 2010/0050631 | A1 | 3/2010 | Yager | |
| 2010/0146949 | A1 | 6/2010 | Stobart et al. | |
| 2010/0194111 | A1 | 8/2010 | Van Den Bossche et al. | |
| 2010/0263380 | A1 | 10/2010 | Biederman et al. | |
| 2010/0287934 | A1 | 11/2010 | Glynn et al. | |
| 2010/0307155 | A1 | 12/2010 | Kasuya et al. | |
| 2010/0313565 | A1* | 12/2010 | Kaplan et al. | 60/670 |
| 2010/0326076 | A1 | 12/2010 | Ast et al. | |
| 2011/0115445 | A1 | 5/2011 | Bronicki et al. | |
| 2011/0138807 | A1* | 6/2011 | Ulrey | F01N 5/02 60/605.1 |
| 2011/0187119 | A1 | 8/2011 | McMaster | |
| 2011/0209473 | A1* | 9/2011 | Fritz | F01K 23/065 60/605.2 |
| 2011/0209474 | A1 | 9/2011 | Leibowitz | |
| 2011/0289922 | A1 | 12/2011 | Myers et al. | |
| 2012/0000200 | A1* | 1/2012 | Freund | F01K 23/10 60/645 |
| 2012/0073295 | A1 | 3/2012 | Enokijima et al. | |
| 2012/0090293 | A1 | 4/2012 | Barrieu | |
| 2012/0090295 | A1* | 4/2012 | Yacoub | F01N 3/0871 60/274 |
| 2012/0174581 | A1 | 7/2012 | Vaughan et al. | |
| 2012/0192563 | A1 | 8/2012 | Kauffman et al. | |
| 2012/0198839 | A1* | 8/2012 | Nelson et al. | 60/605.1 |
| 2012/0223531 | A1 | 9/2012 | Brooks et al. | |
| 2012/0285169 | A1* | 11/2012 | Freund et al. | 60/643 |
| 2012/0286524 | A1 | 11/2012 | Bronicki | |
| 2012/0299297 | A1 | 11/2012 | Shortlidge et al. | |
| 2012/0299311 | A1 | 11/2012 | Biederman et al. | |
| 2013/0047613 | A1 | 2/2013 | Holt et al. | |
| 2013/0062890 | A1 | 3/2013 | Saar et al. | |
| 2013/0081395 | A1 | 4/2013 | Frey et al. | |
| 2013/0207402 | A1 | 8/2013 | Bronicki et al. | |
| 2014/0028033 | A1 | 1/2014 | Mirmobin et al. | |
| 2015/0107249 | A1 | 4/2015 | Artinian et al. | |
| 2015/0300202 | A1 | 10/2015 | Maeda | |

FOREIGN PATENT DOCUMENTS

| | | |
|---|---|---|
| KR | 1020110116738 | 10/2011 |
| KR | 1020130032222 | 4/2013 |
| WO | WO 99/67102 | 12/1999 |

OTHER PUBLICATIONS

International Search Report and Written Opinion of the International Searching Authority issued in International Application No. PCT/US2014/035414 on Aug. 19, 2014; 9 pages.

Non final office action issued in U.S. Appl. No. 13/556,821 on May 29, 2014, 19 pages.

Non final office action issued in U.S. Appl. No. 13/556,821 on Feb. 24, 2015, 19 pages.

PCT International Preliminary Report on Patentability, PCT/US2014/035414, Nov. 5, 2015, 6 pages.

PCT Notification of Transmittal of the International Search Report and Written Opinion of the International Searching Authority, PCT/US2014/035581, Jan. 28, 2016, 9 pages.

Final office action issued in U.S. Appl. No. 14/059,727 on Apr. 7, 2016, 15 pages.

* cited by examiner

HEAT SOURCES FOR THERMAL CYCLES

FIELD

The present disclosure pertains to dual heat sources for a closed-loop thermal cycle that can use the heat sources independently or concurrently.

BACKGROUND

In many thermal cycle applications, a heat source is used that may be part of a larger plant process. A heat source may provide direct or indirect heat to a heat exchanger of the closed-loop thermal cycle. The heat from the heat source can heat a working fluid of the closed-loop thermal cycle upstream of a generator apparatus.

SUMMARY

Certain aspects of the disclosure are directed to a system that includes a closed-loop thermal cycle and an engine system. The a closed-loop thermal cycle may include an evaporator configured to receive a heated thermal fluid and heat a working fluid. The closed-loop thermal cycle may also include an electric machine configured to receive the heated working fluid and generate electrical power by rotation of a rotor in a stator. The engine system may include an engine having an exhaust outlet. A bypass duct may connected downstream of the engine exhaust outlet and can be configured to selectively direct exhaust from the exhaust outlet away from an exhaust stack. A first heat exchanger may reside along the bypass duct and may be configured to receive heat from exhaust in the bypass duct. The engine system may also include a turbocharger in fluid communication with the exhaust outlet of the engine. A second heat exchanger may be configured to receive heat from an output of the turbocharger. The system may include a three-way valve configured to selectively direct the thermal fluid of the closed-loop thermal cycle between the evaporator and one of the first heat exchanger or the second heat exchanger. The three-way valve may be controlled by a controller that is configured to control the three way valve based on the operating capacity of the engine compared against a threshold capacity value.

Certain aspects of the disclosure are directed to a method for heating a thermal fluid of a closed-loop thermal cycle. It can be determined (e.g., by the controller) whether an engine is operating above or below a threshold capacity. If the engine is operating above a threshold capacity, using heated air from the turbocharger. If the engine is operating at or below a threshold capacity, the thermal fluid can be heated using exhaust from the engine. In either case, the closed-loop thermal cycle can receive a heated thermal fluid to operate the electric machine.

Certain implementations may include directing the exhaust from an output of the engine to a bypass duct if the engine is operating at or below a threshold capacity. Certain implementations may include directing the exhaust through an exhaust stack if the engine is operating above a threshold capacity. The exhaust in the exhaust stack can be used to heat water to create steam.

In certain implementations, heating the working fluid with heated air from the turbocharger compressor output may include directing the heated air from the turbocharger to a heat exchanger of the closed-loop thermal cycle.

In certain implementations, heating the working fluid with heated air from the turbocharger may include heating a heat exchange fluid with the heated air at a heat exchanger residing downstream of the turbocharger and directing the heated heat exchange fluid to a heat exchanger of the closed-loop thermal cycle to heat the working fluid.

In certain implementations, heating the working fluid with exhaust from the engine comprises directing the exhaust a heat exchanger of the closed-loop thermal cycle.

In certain implementations, heating the working fluid with exhaust from the engine may include heating a heat exchange fluid with the exhaust at a heat exchanger residing in-line with a bypass duct and directing the heated heat exchange fluid to a heat exchanger of the closed-loop thermal cycle to heat the working fluid.

In certain implementations, the controller is configured to determine the engine capacity and selectively control the three-way valve to either open a fluid pathway between the evaporator and the first heat exchanger if the engine is operating at or below a threshold capacity or open a fluid pathway between the closed loop thermal cycle and the second heat exchanger if the engine is operating above the threshold capacity.

In certain implementations, the operating capacity is based on one or more of an engine load, exhaust temperature, exhaust mass flow rate, turbocharger output temperature, or turbocharger.

Certain implementations may include an exhaust stack in fluid communication with the exhaust outlet and a third heat exchanger configured to receive heat from the exhaust stack and boil water.

In certain implementations, the engine is an engine of a marine vessel. In certain implementations, the closed-loop thermal cycle is on board the marine vessel.

In certain implementations, the closed-loop thermal cycle comprises an organic Rankine cycle.

BRIEF DESCRIPTION OF THE DRAWINGS

Like reference numbers denote like components.

DETAILED DESCRIPTION

The disclosure describes providing heat for closed-loop thermal cycles onboard marine merchant vessels from multiple heat sources. A closed-loop thermal cycle module can utilize the exhaust heat in a bypass duct when an engine is operating below a threshold load (e.g., below 45% load for a marine engine) and can utilize compressed air heat when the engine is above a threshold load (e.g., above 45% load for the marine engine). By using dual, independent heat sources, a closed-loop thermal cycle operate on a marine vessel constantly regardless of the operating mode of the engine. The payback time of the closed-loop thermal cycle can thereby be decreases. The closed-loop thermal cycle system can also utilize direct heat where the thermal cycle thermal fluid is directly in contact with the heat source. The closed-loop thermal cycle can therefore be adapted to receive heat from different types of heat sources, including gas-based heat and liquid-based heat.

Figure 1A:
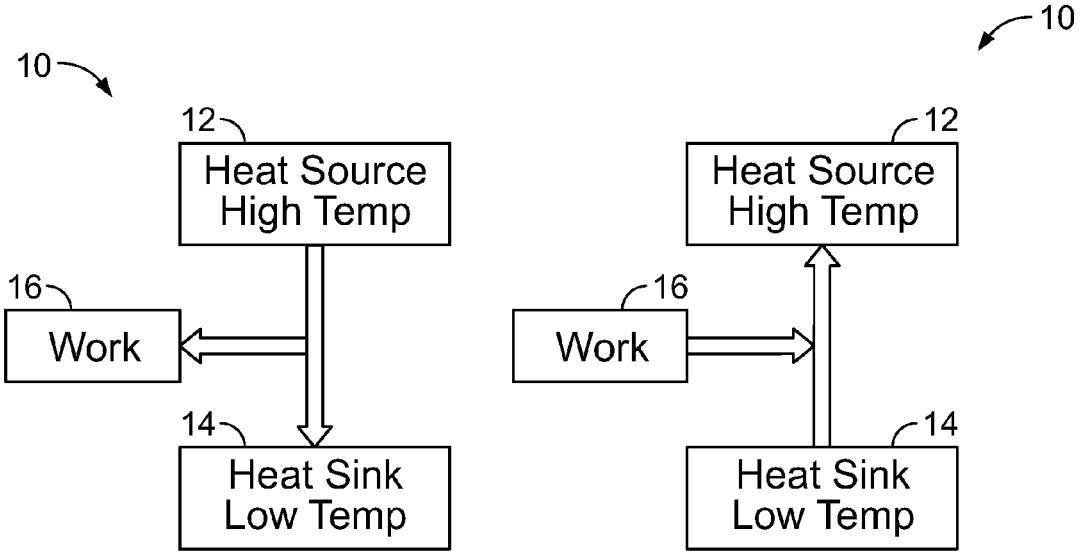
FIG. 1A is a schematic diagram of an example thermal cycle.

FIG. 1A is a schematic diagram of an example thermal cycle 10. The cycle includes a heat source 12 and a heat sink 14. The heat source temperature is greater than heat sink temperature. Flow of heat from the heat source 12 to heat sink 14 is accompanied by extraction of heat and/or work 16 from the system. Conversely, flow of heat from heat sink 14 to heat source 12 is achieved by application of heat and/or work 16 to the system. Extraction of heat from the heat source 12 or application of heat to heat sink 14 is achieved through a heat exchanging mechanism. Systems and apparatus described in this disclosure are applicable to any heat sink 14 or heat source 12 irrespective of the thermal cycle. For descriptive purposes, a Rankine Cycle (or Organic Rankine Cycle) is described by way of illustration, though it is understood that the Rankine Cycle is an example thermal cycle, and this disclosure contemplates other thermal cycles. Other thermal cycles within the scope of this disclosure include, but are not limited to, Sterling cycles, Brayton cycles, Kalina cycles, etc.

Figure 1B:
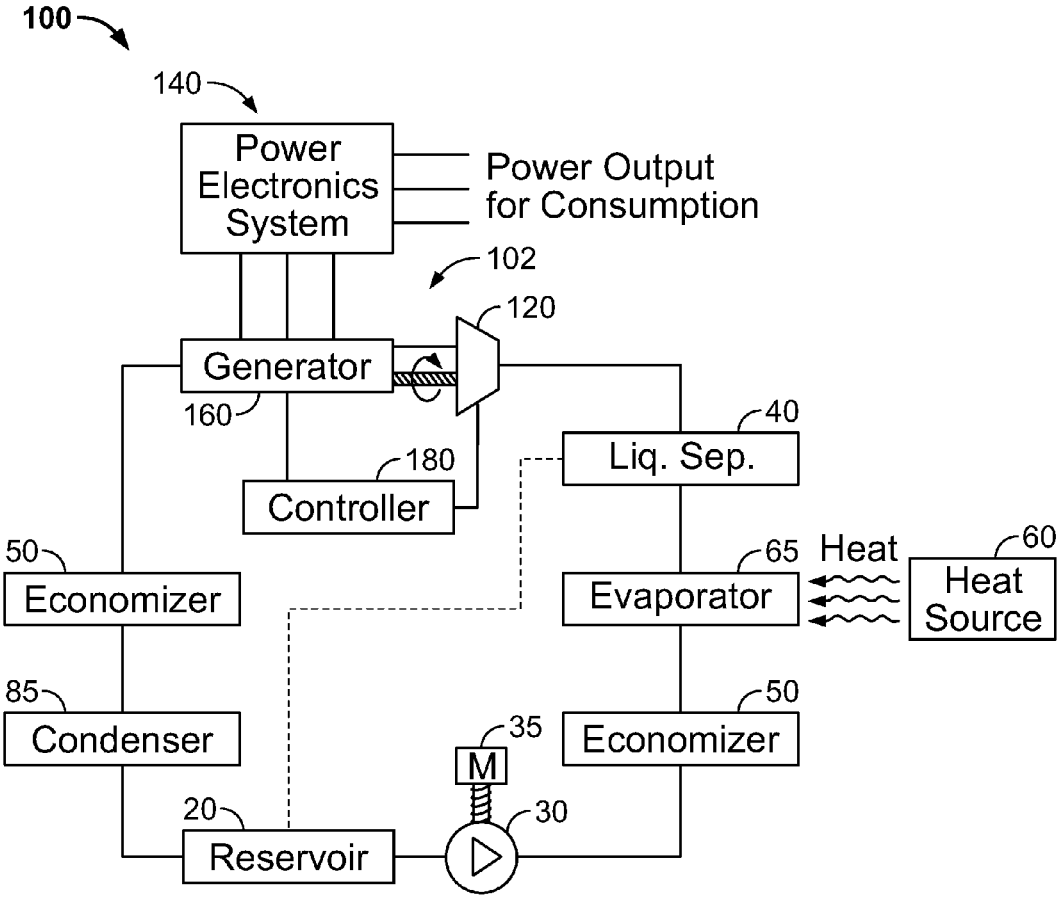
FIG. 1B is a schematic diagram of an example Rankine Cycle system illustrating example Rankine Cycle system components.

FIG. 1B is a schematic diagram of an example Rankine Cycle system 100 illustrating example Rankine Cycle system components. Elements of the Rankine Cycle 100 may be integrated into any waste heat recovery system. The Rankine Cycle 100 may be an Organic Rankine Cycle ("Rankine Cycle"), which uses an engineered working fluid to receive waste heat from another process, such as, for example, from the heat source plant that the Rankine Cycle system components are integrated into. In certain instances, the working fluid may be a refrigerant (e.g., an HFC, CFC, HCFC, ammonia, water, R245fa, or other refrigerant). In some circumstances, the working fluid in thermal cycle 100 may include a high molecular mass organic fluid that is selected to efficiently receive heat from relatively low temperature heat sources. As such, the turbine generator apparatus 102 can be used to recover waste heat and to convert the recovered waste heat into electrical energy.

In certain instances, the turbine generator apparatus 102 includes a turbine expander 120 and a generator 160. The turbine generator apparatus 102 can be used to convert heat energy from a heat source into kinetic energy (e.g., rotation of the rotor), which is then converted into electrical energy. The turbine expander 120 is configured to receive heated and pressurized gas, which causes the turbine expander 120 to rotate (and expand/cool the gas passing through the turbine expander 120). Turbine expander 120 is coupled to a rotor of generator 160 using, for example, a common shaft or a shaft connected by a gear box. The rotation of the turbine expander 120 causes the shaft to rotate, which in-turn, causes the rotor of generator 160 to rotate. The rotor rotates within a stator to generate electrical power. For example, the turbine generator apparatus 102 may output electrical power that is configured by a power electronics package to be in form of 3-phase 60 Hz power at a voltage of about 400 VAC to about 480 VAC. Alternative embodiments may output electrical power at different power and/or voltages. Such electrical power can be transferred to a power electronics system 140, other electrical driven components within or outside the engine compressor system and, in certain instances, to an electrical power grid system. Turbine may be an axial, radial, screw or other type turbine. The gas outlet from the turbine expander 120 may be coupled to the generator 160, which may receive the gas from the turbine expander 120 to cool the generator components.

The power electronics 140 can operate in conjunction with the generator 160 to provide power at fixed and/or variable voltages and fixed and/or variable frequencies. Such power can be delivered to a power conversion device configured to provide power at fixed and/or variable voltages and/or frequencies to be used in the system, distributed externally, or sent to a grid. The power electronics 140 essentially decouples the electrical components from the mechanical components of the generator 160. Therefore, the generator 160 can receive working fluid heated from different sources and from fluid that have different mass flow rates and different temperatures (and different physical states).

Rankine Cycle 100 may include a pump device 30 that pumps the working fluid. The pump device 30 may be coupled to a liquid reservoir 20 that contains the working fluid, and a pump motor 35 can be used to operate the pump. The pump device 30 may be used to convey the working fluid to a heat exchanger 65 (the term "heat exchanger" will be understood to mean one or both of an evaporator or a heat exchanger). The heat exchanger 65 may receive heat from a heat source 60, such as a waste heat source from one or more heat sources. In such circumstances, the working fluid may be directly heated or may be heated in a heat exchanger in which the working fluid receives heat from a byproduct fluid of the process. In certain instances, the working fluid can cycle through the heat source 60 so that at least a substantial portion of the fluid is converted into gaseous state. Heat source 60 may also indirectly heat the working fluid with a thermal fluid that carries heat from the heat source 60 to the evaporator 65. Some examples of a thermal fluid include water, steam, thermal oil, etc.

Rankine Cycle 100 may include a bypass that allows the working fluid to partially or wholly bypass the turbine expander 120. The bypass can be used in conjunction with or isolated from the pump device 30 to control the condition of working fluid around the closed-loop thermal cycle. The bypass line can be controlled by inputs from the controller 180. For example, in some instances, the bypass can be used to control the output power from the generator by bypassing a portion of the working fluid from entering the turbine expander 120.

Typically, working fluid at a low temperature and high pressure liquid phase from the pump device 30 is circulated into one side of the economizer 50, while working fluid that has been expanded by a turbine upstream of a condenser heat exchanger 85 is at a high temperature and low pressure vapor phase and is circulated into another side of the economizer 50 with the two sides being thermally coupled to facilitate heat transfer there between. Although illustrated as separate components, the economizer 50 (if used) may be any type of heat exchange device, such as, for example, a plate and frame heat exchanger, a shell and tube heat exchanger or other device.

The evaporator/preheater heat exchanger 65 may receive the working fluid from the economizer 50 at one side and receive a supply of thermal fluid (that is (or is from) the heat source 60) at another side, with the two sides of the evaporator/preheater heat exchanger 65 being thermally coupled to facilitate heat exchange between the thermal fluid and working fluid. For instance, the working fluid enters the evaporator/preheater heat exchanger 65 from the economizer 50 in liquid phase and is changed to a vapor phase by heat exchange with the thermal fluid supply. The evaporator/preheater heat exchanger 65 may be any type of heat exchange device, such as, for example, a plate and frame heat exchanger, a shell and tube heat exchanger or other device.

In certain instances of the Rankine Cycle 100, the working fluid may flow from the outlet conduit of the turbine generator apparatus 102 to a condenser heat exchanger 85. The condenser heat exchanger 85 is used to remove heat from the working fluid so that all or a substantial portion of the working fluid is converted to a liquid state. In certain instances, a forced cooling airflow or water flow is provided over the working fluid conduit or the condenser heat exchanger 85 to facilitate heat removal. After the working fluid exits the condenser heat exchanger 85, the fluid may return to the liquid reservoir 20 where it is prepared to flow again though the Rankine Cycle 100. In certain instances, the working fluid exits the generator 160 (or in some instances, exits a turbine expander 120) and enters the economizer 50 before entering the condenser heat exchanger 85.

Liquid separator 40 (if used) may be arranged upstream of the turbine generator apparatus 102 so as to separate and remove a substantial portion of any liquid state droplets or slugs of working fluid that might otherwise pass into the turbine generator apparatus 102. Accordingly, in certain instances of the embodiments, the gaseous state working fluid can be passed to the turbine generator apparatus 102, while a substantial portion of any liquid-state droplets or slugs are removed and returned to the liquid reservoir 20. In certain instances of the embodiments, a liquid separator may be located between turbine stages (e.g., between the first turbine wheel and the second turbine wheel, for multi-stage expanders) to remove liquid state droplets or slugs that may form from the expansion of the working fluid from the first turbine stage. This liquid separator may be in addition to the liquid separator located upstream of the turbine apparatus.

Controller 180 may provide operational controls for the various cycle components, including the heat exchangers and the turbine generator.

Figure 2:
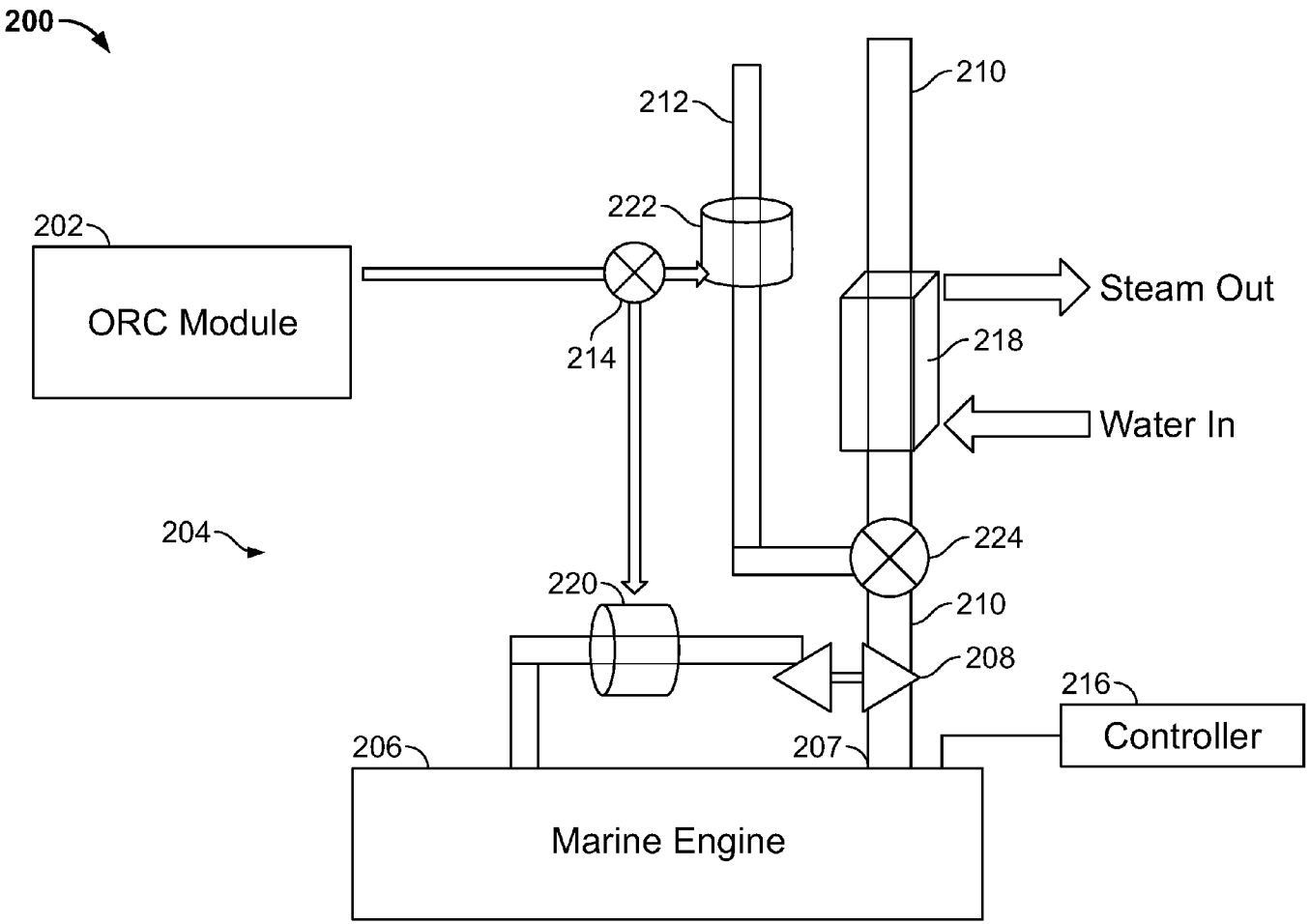
FIG. 2 is a schematic diagram of an example dual heat source in fluid communication with a closed-loop thermal cycle.

FIG. 2 is a schematic diagram of an example system 200 coupled to a closed-loop thermal cycle module 202. The closed-loop thermal cycle module 202 can include some or all of the features of the closed-loop thermal cycle (Rankine cycle 100) described and shown in FIG. 1B. The engine 206 may be an engine from a marine merchant vessel. Certain applications can vary design point operational protocols of the maritime vessel's systems depending on loads or other practical requirements. As an example, marine merchant vessels may not be following the design point operational protocols for propulsion for a variety of reasons. Depending on the load, destination, and fuel prices, the vessel may operate its propulsion engines at anywhere between 20% to 80% capacity. This variable mode of operation may change the operating temperature and pressures of various gases, such as compressed air for combustion and exhaust output. The system 200 shown in FIG. 2 illustrates an engine system that can provide heat to a closed-loop thermal cycle in both modes of operation.

In FIG. 2, the engine system 204 includes an engine 206, an exhaust outlet 207, a turbocharger 208, an exhaust stack 210, and a bypass duct 212. When the engine 206 is operating below a threshold capacity (e.g., 45% load factor), the exhaust stack 210 may be bypassed a heat exchanger 218 using the bypass duct 212 because the temperature of the exhaust is below a certain level (e.g., 250 C in some cases). Without the bypass duct 212, the exhaust can reach a critical temperature in the exhaust stack 210 and leave residue on the heat exchanger 218 (e.g., a boiler utilized to make steam), which can be expensive equipment and difficult to clean. Furthermore, when the engine 206 is operating below the threshold capacity (e.g., below 35% load), the turbocharger 208 may also be not able to deliver compressed air of high enough temperature to utilize its thermal energy for electric power generation. A bypass valve 224 may facilitate the selective fluid pathways from the exhaust outlet 207 and one of the exhaust stack 210 or the bypass duct 212. The bypass valve 224 can be controlled by controller 216. Controller 216 can selectively control the bypass valve 224 based on an engine output capacity, exhaust temperature or flow rate, or other parameters.

In the example scenario above, the exhaust in the bypass duct 212 may be used to heat a thermal fluid for the closed-loop thermal cycle. A three-way valve 214 can be opened to allow the thermal fluid to flow from the closed-loop thermal cycle module 202 to the heat exchanger 222, where it is heated by the exhaust in the bypass duct 212. The three-way valve 214 can be controlled by a controller 216 that can receive signals from the engine 206 or other areas of the engine system 204 indicating the engine operating capacity, the temperature of the exhaust in the exhaust stack 210, the mass flow-rate of the exhaust, the temperature and/or mass-flow rate of the output of the turbocharger, and/or other metrics that can be used to indicate engine operating capacity. The three-way valve positions can be totally open, totally closed, or partially open and partially closed.

When the engine is operating above a threshold capacity (e.g., above 35% capacity), the exhaust may be above 250 C and would be allowed to flow through the exhaust stack 210 without flowing through the bypass duct 212. The exhaust in the exhaust stack 210 can pass through a heat exchanger 218 that can transfer heat to water to make steam; the exhaust can then exit the top of the exhaust stack 210. Heat exchanger 218 may be a boiler or other heat exchanger.

When the engine is operating above a threshold capacity (e.g., above 45% capacity), the exhaust can flow through a turbine of a turbocharger 208 that may be in the exhaust path. The turbocharger 208 can provide enough air at a high enough pressure and mass flow rate such that the compressed air needs to be cooled before entering the engine 206. Compressed air temperature from the turbocharger 208 can be 200 C. When the engine is operating above the threshold capacity, the three-way valve 214 can be opened such that the thermal fluid is directed from the closed-loop thermal cycle module 202 to a heat exchanger 220 residing downstream of the turbocharger 208.

Figure 3:
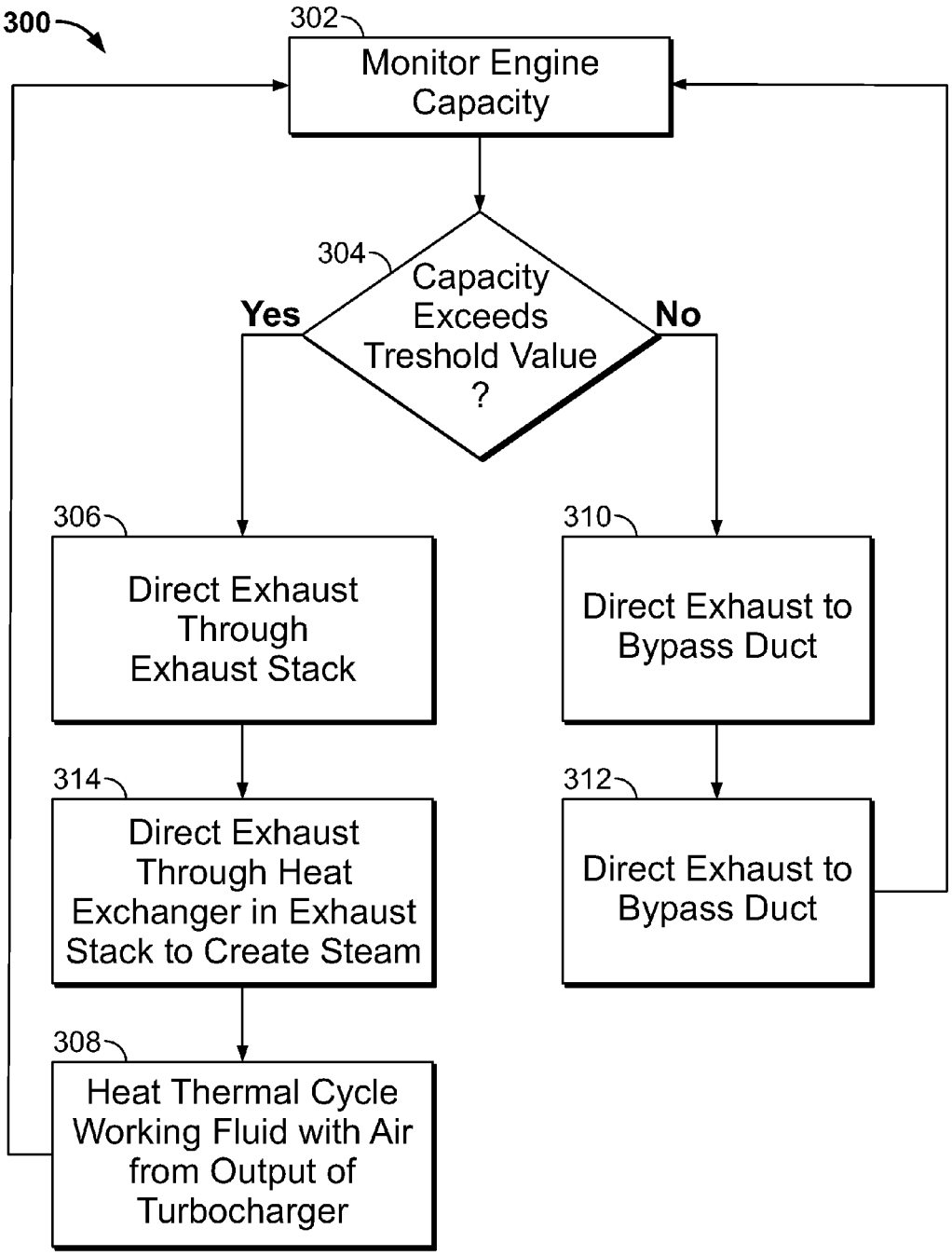
FIG. 3 is a process flow diagram of an example process for providing heat from one of a plurality of heat sources to a closed-loop thermal cycle.

FIG. 3 is a process flow diagram 300 of an example process for heating a working fluid of a closed-loop thermal cycle. A capacity at which an engine is operating can be monitored (302). In some implementations, the engine comprising a turbocharger. It can be determined whether the engine is operating above a threshold capacity (304). If the engine is operating above a threshold capacity, the working fluid can be heated with heated air from the turbocharger (308). Heating the working fluid with heated air from the turbocharger can include directing the heated air from the turbocharger to a heat exchanger of the closed-loop thermal cycle. Heating the working fluid with heated air from the turbocharger can include heating a heat exchange fluid with the heated air at a heat exchanger residing downstream of the turbocharger and directing the heated heat exchange fluid to a heat exchanger of the closed-loop thermal cycle to heat the working fluid.

If the engine is operating at or below a threshold capacity, the working fluid can be heated with exhaust from the engine (312). Heating the working fluid with exhaust from the engine comprises directing the exhaust a heat exchanger of the closed-loop thermal cycle. Heating the working fluid with exhaust from the engine can include heating a heat exchange fluid with the exhaust at a heat exchanger residing in-line with a bypass duct and directing the heated heat exchange fluid to a heat exchanger of the closed-loop thermal cycle to heat the working fluid.

In some implementations, if the engine is operating at or below a threshold capacity, the exhaust from an output of the engine can be directed to a bypass duct (310).

In some cases, if the engine is operating above a threshold capacity, the exhaust can be directed through an exhaust stack (306). In those cases, the exhaust can be used to heat water to create steam with the exhaust in the exhaust stack (314).

A number of embodiments have been described. Nevertheless, it will be understood that various modifications may be made. For example, the sources of heat could be different than those described here. A solar heat source can be used in conjunction with a geothermal heat source. Likewise, gas and/or liquid can be used to deliver heat to the ORC. The transition between heat sources can be seamless or one heat source can be shut off before the second one turns on. The transitions may be implemented mechanically or electrically. Accordingly, other embodiments are within the scope of the following claims:

What is claimed is:

1. A method for heating a thermal fluid of a closed-loop electrical power generating organic Rankine thermal cycle, the method comprising:

determining an operating capacity of a maritime vessel engine, the engine comprising a turbocharger;

comparing the operating capacity of the engine with a threshold capacity of the engine; in response to determining that the operating capacity of the engine is above the threshold capacity;

heating, in a first heat exchanger coupled to a compressor outlet of the turbocharger, the thermal fluid with heated air output to the first heat exchanger from a turbocharger compressor of the turbocharger, providing exhaust from an exhaust outlet of the engine through an exhaust stack coupled to the exhaust outlet of the engine, entirely bypassing a bypass duct that is coupled to the exhaust stack, generating steam from water in a second heat exchanger in the exhaust stack with the exhaust provided from the exhaust outlet of the engine through the exhaust stack, and in response to determining that the operating capacity of the engine is at or below the threshold capacity;

providing exhaust from the exhaust outlet of the engine through the bypass duct, entirely bypassing the exhaust stack, and heating, in a third heat exchanger in the bypass duct, the thermal fluid with the exhaust provided from the engine through the bypass duct.

2. The method of claim 1, further comprising, in response to determining that the engine is operating at or below the threshold capacity, operating a bypass valve in fluid communication with the exhaust outlet, the exhaust stack and the bypass duct to direct the exhaust from the exhaust outlet to the bypass duct while bypassing the exhaust stack.

3. The method of claim 1, further comprising, in response to determining that the engine is operating above the threshold capacity, operating a bypass valve in fluid communication with the exhaust outlet, the exhaust stack and the bypass duct to direct the exhaust from the exhaust outlet through the exhaust stack while bypassing the bypass duct.

4. The method of claim 1, comprising heating a working fluid of the thermal cycle with the heated thermal fluid and constantly operating the thermal cycle to generate electrical power regardless of whether the engine operating capacity is above or below the threshold capacity.

5. A system comprising:

a closed-loop organic Rankine thermal cycle comprising;

an evaporator configured to receive a heated thermal fluid and, using the heated thermal fluid, heat a Rankine thermal cycle working fluid, and an electric machine configured to generate electrical power by rotation of a rotor in a stator using heat extracted from the Rankine cycle working fluid; and an engine system coupled to the Rankine thermal cycle, the engine system comprising:

a marine vessel engine having an exhaust outlet, an exhaust stack coupled to the exhaust outlet to receive exhaust from the exhaust outlet, a bypass duct coupled to the exhaust stack downstream of the exhaust outlet to receive exhaust from the exhaust outlet;

a bypass valve in the exhaust stack and coupled to the bypass duct, the bypass valve changeable between directing exhaust through the exhaust stack, entirely bypassing the bypass duct and directing exhaust through the bypass duct, entirely bypassing remainder of the exhaust stack downstream of the bypass valve;

a first heat exchanger in the bypass duct and in a flow path of the exhaust being provided from the exhaust outlet through the bypass duct, the first heat exchanger configured to heat a thermal fluid of the Rankine thermal cycle with the exhaust provided from the exhaust outlet through the bypass duct, a second heat exchanger in the exhaust stack and in a flow path of the exhaust provided from the exhaust outlet through the exhaust stack, the second heat exchanger configured to receive water and to generate steam from the water using the exhaust provided from the exhaust outlet through the exhaust stack, a turbocharger in fluid communication with the exhaust outlet of the engine, a third heat exchanger connected to the turbocharger and in a flow path of heated air from a turbocharger compressor outlet, the third heat exchanger configured to heat the thermal fluid of the Rankine thermal cycle with the heated air from the turbocharger compressor outlet, and a three-way valve connecting the evaporator of the Rankine thermal cycle, the first heat exchanger and the third heat exchanger, the three-way valve configured to direct the thermal fluid between the evaporator and one of the first heat exchanger or the third heat exchanger while bypassing the other of the first heat exchanger or the third heat exchanger.

6. The system of claim 5, wherein the three-way valve is selectively controlled to:

open a fluid pathway between the evaporator and the first heat exchanger if the engine is operating at or below a threshold capacity; and open a fluid pathway between the closed loop thermal cycle and the third heat exchanger if the engine is operating above the threshold capacity.

7. The system of claim 5, wherein the operating capacity is based on one or more of an engine load, exhaust temperature, exhaust mass flow rate, turbocharger output temperature, or turbocharger.

8. A method comprising:

determining an operating capacity of a maritime vessel engine, the engine comprising a turbocharger;

comparing the operating capacity of the engine with a first threshold capacity of the engine and a second, higher threshold capacity of the engine, wherein each of the first threshold capacity and the second threshold capacity is a fraction of a maximum operating capacity of the engine;

in response to determining that the operating capacity of the engine is above the first threshold capacity:

providing exhaust from an exhaust outlet of the engine through an exhaust stack, entirely bypassing a bypass duct connected in parallel to the exhaust stack downstream of the exhaust outlet, and heating water to generate steam with the exhaust provided from the exhaust outlet of the engine through the exhaust stack in a first heat exchanger in the exhaust stack;

providing exhaust from an exhaust outlet of the engine through an exhaust stack, in response to determining that the operating capacity of the engine is above the second threshold capacity, heating the thermal fluid with heated air provided from a turbocharger compressor in a second heat exchanger in fluid communication with the turbocharger compressor and the engine;

in response to determining that the operating capacity of the engine is below the first threshold capacity:

providing exhaust from the exhaust outlet of the engine through the bypass duct, entirely bypassing the exhaust stack, and heating the thermal fluid with the exhaust provided through the bypass duct in a third heat exchanger in the bypass duct.

* * * * *